US009060597B1

(12) United States Patent
Wright et al.

(10) Patent No.: US 9,060,597 B1
(45) Date of Patent: Jun. 23, 2015

(54) RECONFIGURABLE FURNITURE AND MILLWORK USING A CONNECTOR CLIP

(71) Applicants: Bosley Wright, Glen Burnie, MD (US); Jesse James Turner, Baltimore, MD (US)

(72) Inventors: Bosley Wright, Glen Burnie, MD (US); Jesse James Turner, Baltimore, MD (US)

( * ) Notice: Subject to any disclaimer, the term of this patent is extended or adjusted under 35 U.S.C. 154(b) by 0 days.

(21) Appl. No.: 14/031,302

(22) Filed: Sep. 19, 2013

(51) Int. Cl.

| | |
|---|---|
| ***A47B 3/00*** | (2006.01) |
| ***A47B 13/00*** | (2006.01) |
| ***A47B 3/06*** | (2006.01) |
| ***A47B 3/12*** | (2006.01) |

(52) U.S. Cl.
CPC ..... *A47B 13/003* (2013.01); *A47B 3/002* (2013.01); *A47B 3/06* (2013.01); *A47B 3/12* (2013.01)

(58) Field of Classification Search
USPC ..... 108/115, 157.17, 157.14, 157.1, 108/157.18, 12; 248/188.1
See application file for complete search history.

(56) References Cited

U.S. PATENT DOCUMENTS

| | | | | |
|---|---|---|---|---|
| 2,354,106 | A * | 7/1944 | Cooper | 108/12 |
| 2,446,491 | A * | 8/1948 | Schreiner | 108/12 |
| 3,080,193 | A * | 3/1963 | Nimmo | 108/115 |
| 3,722,702 | A * | 3/1973 | Marker, Jr. | 108/115 |
| 3,731,639 | A * | 5/1973 | Schliemann et al. | 108/157.17 |
| 4,033,653 | A * | 7/1977 | Doring et al. | 248/188.1 |
| 6,082,838 | A * | 7/2000 | Bissu-Palombo | 108/115 |
| 6,692,808 | B2 | 2/2004 | Bristow | |
| 6,752,090 | B2 * | 6/2004 | Schenker et al. | 108/115 |
| 6,752,091 | B2 | 6/2004 | Glover | |
| 6,925,665 | B1 | 8/2005 | Hennings | |
| 6,971,321 | B1 | 12/2005 | Strong | |
| 6,997,115 | B2 * | 2/2006 | Lockwood et al. | 108/115 |
| 7,100,518 | B2 | 9/2006 | Strong | |
| 7,178,471 | B2 | 2/2007 | Strong | |
| 7,373,889 | B2 | 5/2008 | Nye | |
| 8,096,244 | B1 * | 1/2012 | Bockheim et al. | 108/115 |
| 8,234,983 | B2 | 8/2012 | Randolph | |
| 8,424,471 | B2 | 4/2013 | Zhu | |
| 2012/0266790 | A1 | 10/2012 | Peery | |

* cited by examiner

*Primary Examiner* — Jose V Chen
(74) *Attorney, Agent, or Firm* — Thomas A. O'Rourke; Bodner & O'Rourke, LLP

(57) ABSTRACT

A reconfigurable banquet table includes a table top, a plurality of retaining clips, and two or more base members. The table top bottom surface includes a plurality of pairs of openings. A corresponding plurality of retaining clips are secured thereat. Each retaining clip includes a first flange and a second flange extending from a plate. Each base member includes first and second legs connected a set distance apart. The first and second legs of each base member are received in one pair of the table top openings, and releasably secured therein by the corresponding retaining clips, with one side of each of the first and second legs engaged by the second flange of the respective retaining clip, to cause deflection of the second flange to provide suitable retaining forces. Easy removability of the base members permits interchangeability without requiring tools, for greater functional/aesthetic versatility, easier transport, and more compact storage.

14 Claims, 19 Drawing Sheets

FIG. 6B
FIG. 6E
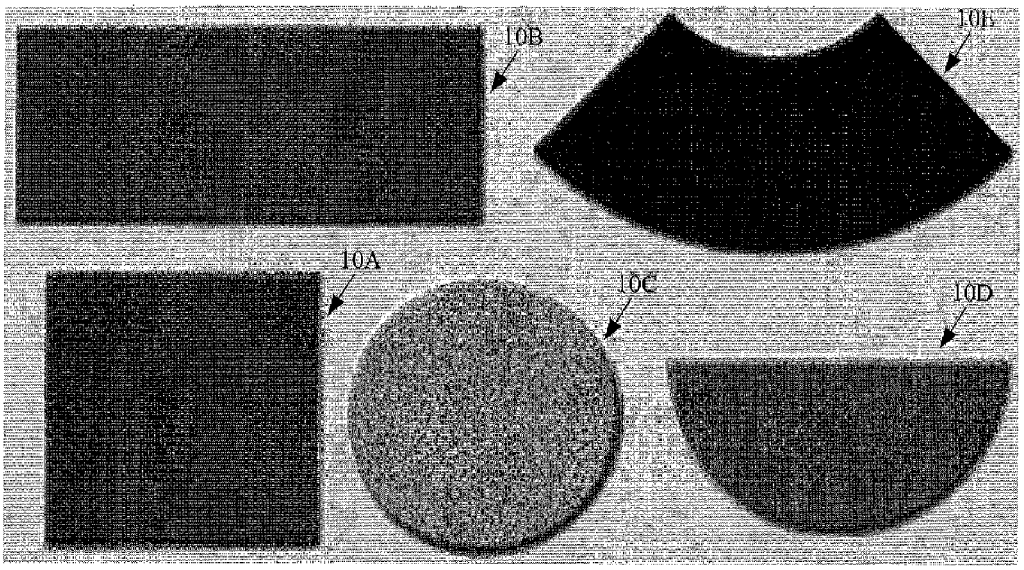
FIG. 6A
FIG. 6C
FIG. 6D
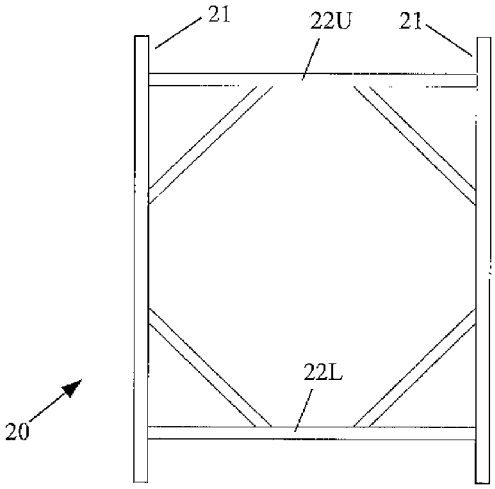
FIG. 7A
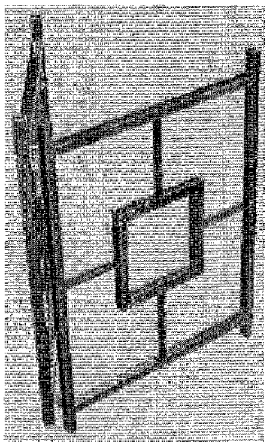
FIG. 7B

RECONFIGURABLE FURNITURE AND MILLWORK USING A CONNECTOR CLIP

FIELD OF THE INVENTION

The present invention relates to improvements in the construction and method of use of furniture and millwork, and more particularly to apparatus and designs permitting the repositioning of base members and legs of a table, using a unique connector clip and various arrangements of the clips with respect to the table top.

BACKGROUND OF THE INVENTION

Tables are typically constructed into many different shapes and sizes to suit the particular function and the aesthetic design that is desired by its user. Tables typically include a table top and legs or base, and are usually limited in versatility, although in some cases it may be equipped with special hardware designed to allow its legs or leaves to fold. Other table configurations may include other attachments or structures to enable additional functionality in addition to its folding capability, but this usually involves the use of screws and hand-tools for the assembly of the component parts.

Banquet tables are one such type of table, and are commonly used for many special events, including school/church functions, reunions, receptions, conventions, weddings, etc. The numerous banquet tables that may be required for a special event, all need to be transported by truck from a storage facility to the location where they are to be utilized, to be carried into the location that is hosting the event, to be set-up thereat, and then they must be desirably positioned/repositioned within the space allotted to the function. Consequently, banquet tables typically have plain table tops formed of plywood or particle board that incorporate the above-mentioned folding legs thereon, so cloth coverings are normally used to mask the bland and/or worn tops/legs to improve the table's aesthetic appearance.

Where a more elegant visual appearance is desired/required for the banquet table, finished hardwoods may be used for the table top, to which an intricate metal base or bases may be secured. However, configurations have the base secured by fasteners or other attachment means requiring the use of tools and/or significant hand strength in the person performing the assembly/disassembly process; therefore they are not capable of assembly and disassembly, and they also are not compact. They also tend to be heavier, which is significant when carrying or carting the tables into the building. A further drawback of these banquet tables is that for a supplier or caterer to offer such tables to its clientele, each design type—different sized and shaped table tops, as well as different styles and heights for the corresponding bases—must be stocked in a sufficient quantity. This means greater storage space and expense—the expense of stocking many more tables, and the expense of acquiring a sufficient inventory of the different styles.

The present invention overcomes these drawbacks by providing a releasable interconnection means for the table top and bases that permits selection from among many different choices of distinctively styled bases of varying different heights, for joining with many different choices of distinctively styled table tops of varying different shapes and sizes. This significantly reduces the quantity of articles that must be purchased and stored by the banquet table supplier. It also reduces the weight of the more elaborately constructed banquet table that must be carried into a wedding hall or other facility, as the bases are easily separable/attachable with respect to the table tops. The interconnection means is also easily releasable, permitting the task of setting up and breaking down the tables to be completed by workers who possess ordinary strength. The parts of the banquet table of the present invention are also easily stored in a compact space, and may be stored on specially constructed carts, where the bases members may be stacked upon each other for such compact storage thereon.

OBJECTS OF THE INVENTION

It is an object of the invention to provide an easily assembled/disassembled banquet table whose configuration may be varied for each assembly, to provide for aesthetically different and functionally different arrangements of the component parts.

It is another object of the invention to provide a furniture top that has a plurality of mounting leg recesses that are selectively arranged to permit repositioning of its legs into various different arrangements.

It is a further object of the invention to provide a special connection clip that is securable to a recess of a furniture top, to be used in releasably securing its leg thereto.

It is another object of the invention to provide a banquet table top and leg assembly that may be easily assembled on-site, and subsequently disassembled to form a compact envelope, for ease of transport and storage.

It is also an object of the invention to provide interchangeable banquet table components that may be assembled in different ways to form various tables of different heights and sizes and shapes, using fewer elements, which permit multiple different combinations having differing aesthetic and functional features to accommodate different catering events/functions.

Further objects and advantages of the invention will become apparent from the following description and claims, and from the accompanying drawings.

SUMMARY OF THE INVENTION

A reconfigurable banquet table includes a table top, a plurality of retaining clips, and two or more base members. The table top bottom surface includes a plurality of pairs of selectively formed openings. A corresponding plurality of retaining clips is fixedly secured the openings. Each retaining clip includes a first flange and a second flange that extend from a plate. The first flange may extend generally orthogonally from the plate, while the second flange may have a double bend to form two flange portions. The first flange portion of the second flange may extend at an acute angle relative to the plate portion. The second flange portion of the second flange may extend from the first flange portion to be substantially parallel to the first flange. Each base member may include first and second legs that may be fixedly connected to each other using a connection means, to be at a set distance apart, which may correspond, in certain embodiments, to the distance that the pairs of openings are spaced apart.

The first and second legs of each base member may be received in one pair of the table top openings, and may be releasably secured therein by the corresponding retaining clips, with one side of each of the first and second legs being engaged by the second flange of the respective retaining clip, to cause deflection of the second flange to create suitable retaining forces, by pinching the leg between the first and second flanges. Easy removability of the base members permits interchangeability without requiring tools, for greater functional/aesthetic versatility, easier transport, and more compact storage. Easy removal of the base legs from the table top is provided by adjusting the bearing forces created by the angled second flange of the retaining clip to produce a retaining force that is just sufficient to maintain the base attached to the underside of the table top, even when being carried and moved about, but it may nonetheless be removed by moderate forces applied by a worker possessing average strength.

Greater stability may be provided for the attachment of the base legs within the paired openings by the retaining clips, by utilizing an friction fit with respect to one dimension of the leg's cross-section (e.g., it lengthwise direction) and the corresponding direction (sides) of the opening in the table top. The total retention force from both contributions—the bearing forces from the clip pinching the leg and the friction fit of the leg in the table top opening—may still both be just sufficient to maintain the base attached to the table top, until positively removed by a worker.

Additional stability may be introduced into the arrangement by furthermore assembling the clips onto the bottom surface of the table top to face in opposite directions, and by spacing the legs so at to furthermore create a friction fit with respect to the outer sides of the pair of openings, which, in addition to providing another friction fit (all of which may still total the requisite retaining force needed), provides rigidity as it also serves to counter any tendency of the legs to rotate within the openings. A doubler may be added to the table top bottom surface to locally increase the depth of the openings to provide further stability without adding excessive weight.

BRIEF DESCRIPTION OF THE DRAWINGS

FIG. 6A illustrates the periphery and top surface a first table top embodiment of the present invention, with its periphery being square in shape.

FIG. 6B illustrates the periphery and top surface a second table top embodiment of the present invention, with its periphery being rectangular in shape.

FIG. 6C illustrates the periphery and top surface a third table top embodiment of the present invention, with its periphery being circular in shape.

FIG. 6*d* illustrates the periphery and top surface a fourth table top embodiment of the present invention, with its periphery being semi-circular in shape.

FIG. 6E illustrates the periphery and top surface a fifth table top embodiment of the present invention, with its periphery being part-ring shaped.

FIG. 7A illustrates a first embodiment of a base member of the present invention.

FIG. 7B illustrates a pivotally coupled, base member pair of the present invention.

DETAILED DESCRIPTION OF THE INVENTION

Figure 1:
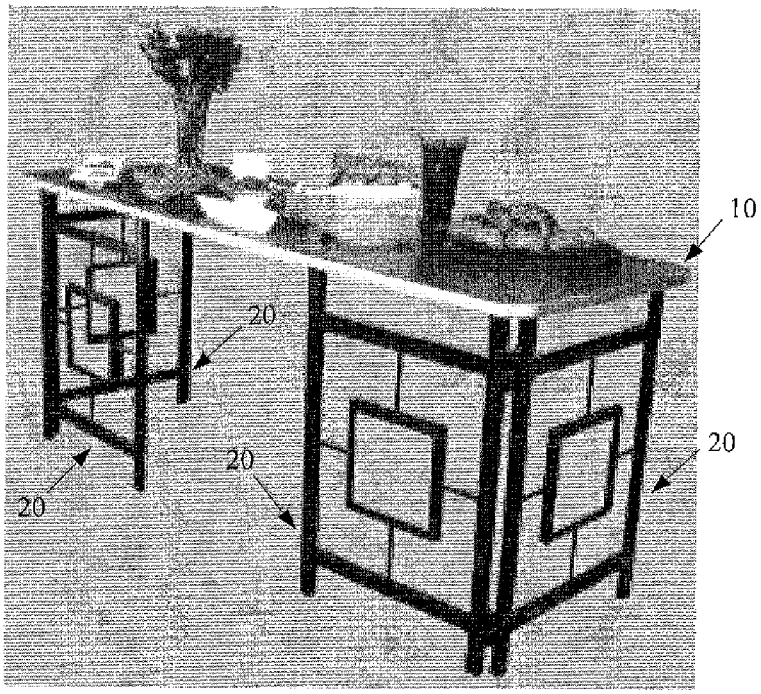
FIG. 1 illustrates a banquet table using the table top, base members, and retaining clips of the present invention, to form a first aesthetic/functional arrangement for the table.
Figure 2:
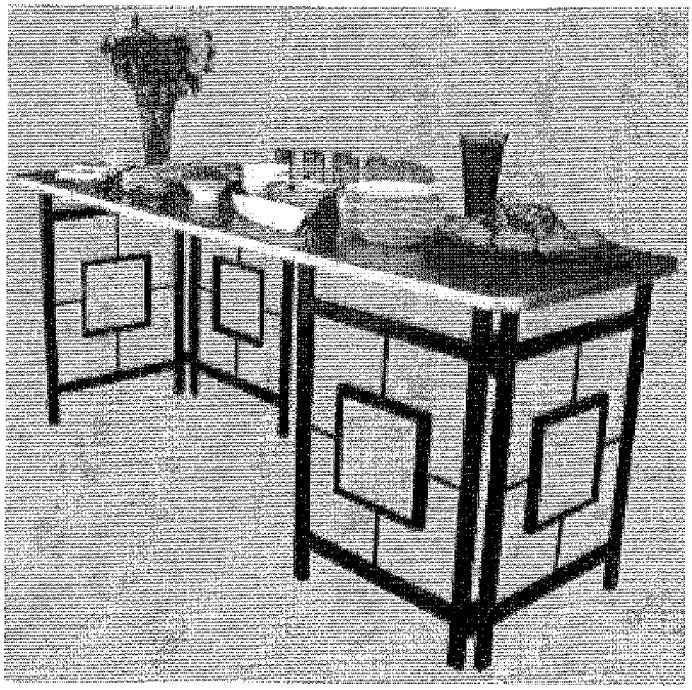
FIG. 2 illustrates the banquet table of FIG. 1, but where one of the base members have been repositioned to a different set of retaining clips and openings in the table top, to form a second aesthetic/functional arrangement for the table.
Figure 3:
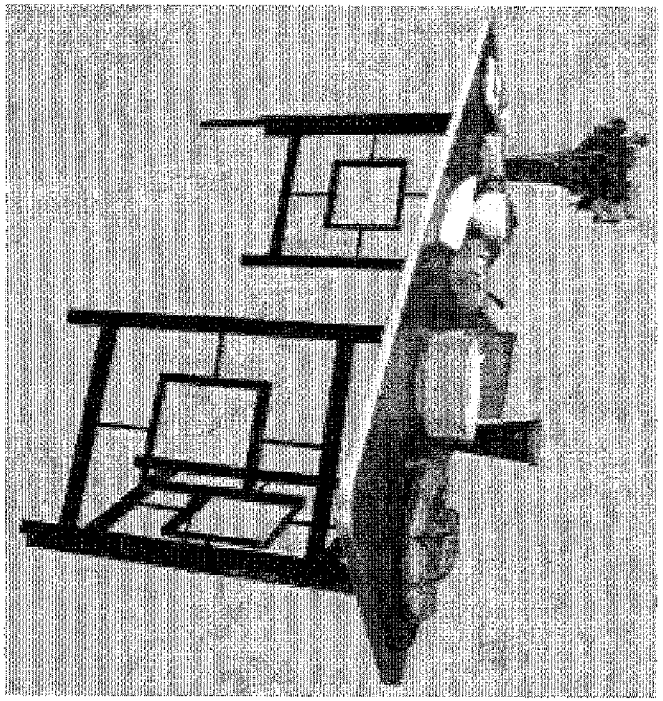
FIG. 3 illustrates the banquet table of FIG. 1, but where all of the base members have been repositioned to a different set of retaining clips and openings in the table top, to form a third aesthetic/functional arrangement for the table.
Figure 4:
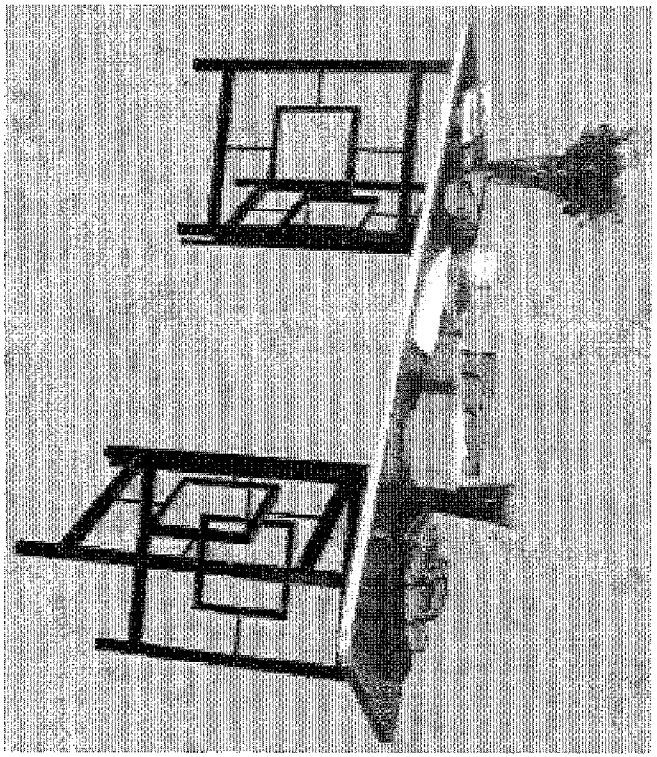
FIG. 4 illustrates the banquet table of FIG. 3, where all of the base members have again been repositioned to a different set of retaining clips and openings in the table top, to form a fourth aesthetic/functional arrangement for the table.
Figure 5:
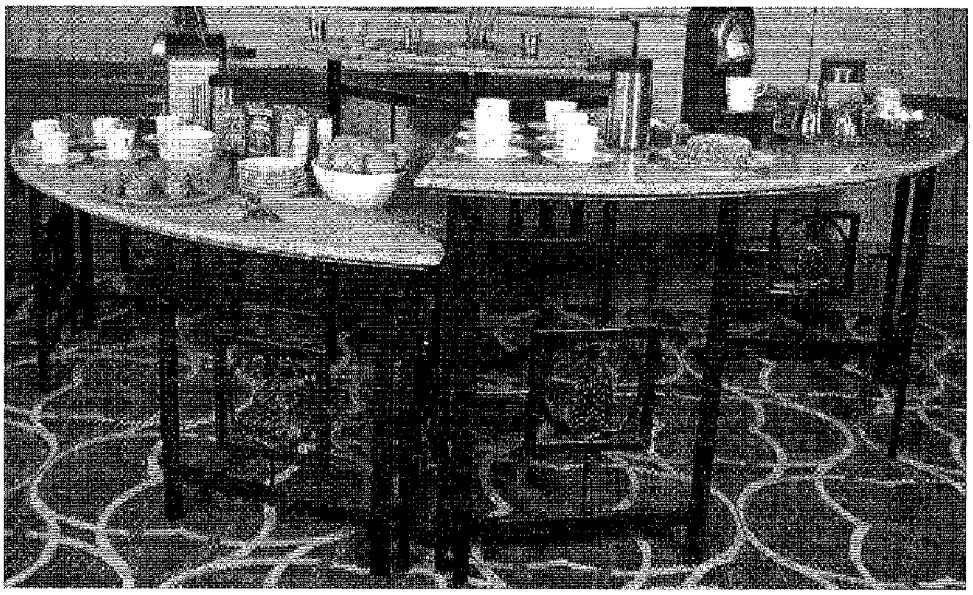
FIG. 5 illustrates an arrangement of three banquet tables, each of which use the table top and retaining clips of the present invention, and where each furthermore uses different heights for the base members, to form a multi-tiered arrangement for the three tables.

FIGS. 1, 2, 3, and 4 each illustrate a banquet table of the present invention that has a unique appearance, but is formed using the same component parts—a rectangular table top and a pair of base members. The banquet tables each have a unique appearance because they may be assembled differently, with the base members being easily repositioned with respect to the table top, using a plurality of specially adapted retaining clips that are secured to the underside of the table top. Thus, the banquet table is reconfigurable. However, this reconfigurable nature of the banquet table of the present invention further lends it to permitting interchangeability of the component parts, to interchange different table top sizes/shapes, and/or to interchange different sizes/styles for the base members. This is illustrated, in part, within FIG. 5, where on the left side a banquet table is formed by a part-ring shaped table top that is support by a pair of base members having a first height, and where on the right side a banquet table is formed by a part-ring shaped table top that is support by a pair of base members of a second height, being taller than the first height.

FIGS. 6A through 6E illustrate some exemplary shapes that may be used for the table tops of the present invention, while FIG. 7A illustrates a base member that may be releasably received by each of the table tops of those figures. To be releasably received by the table top of the present invention, a specially configured retaining clip 30 may be fixedly secured to the bottom surface of the table top at each opening.

Figure 9:
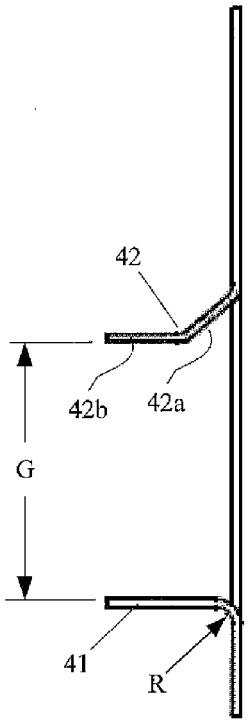
FIG. 9 is a side view of the retaining clip of FIG. 8.
Figure 8:
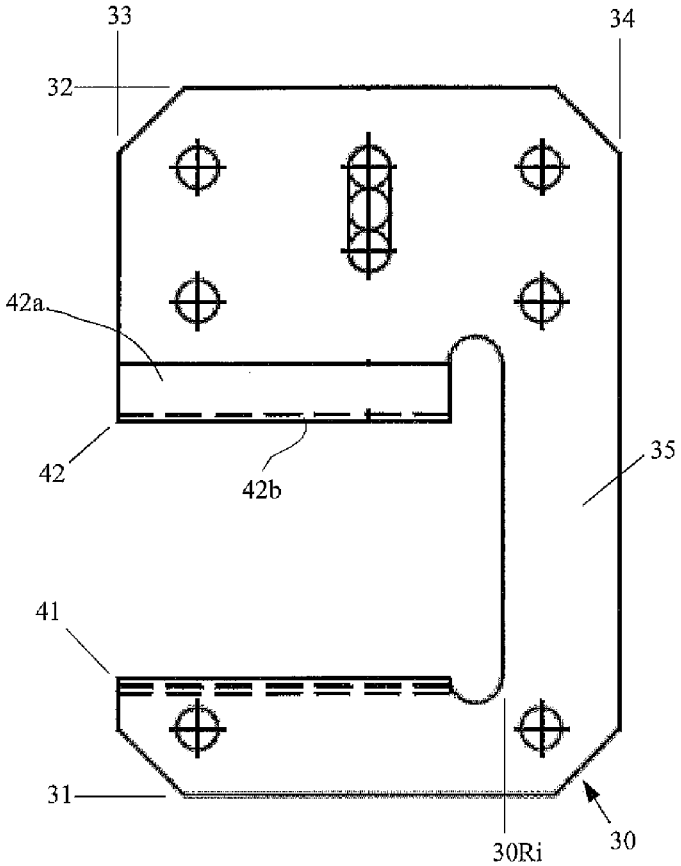
FIG. 8 is a top view of the retaining clip of the present invention.
Figure 10:
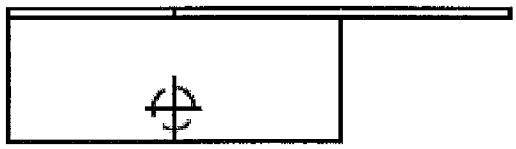
FIG. 10 is an end view of the retaining clip of FIG. 8.

A first embodiment of retaining clip 30 is shown in detail within FIGS. 8-10. The retaining clip 30 shown therein is formed as a bent-up sheet metal part, although it may be formed using other methods. Retaining clip 30 may have a plate portion 35 that may be formed with a periphery that could take one of many different shapes. Merely to be exemplary, plate portion 35 may have, as seen in FIG. 8, a first end 31, a second end 32, which may be parallel to each other, and a third end 33, and a fourth end 34, which may also be parallel to each other, and may be orthogonal to first and second ends 31 and 32. The corners of the generally rectangular plate portion 35, where the orthogonal sides meet, may be radiused, or they may be chamfered, as seen in FIG. 8, or they may be left untrimmed.

Figure 11:
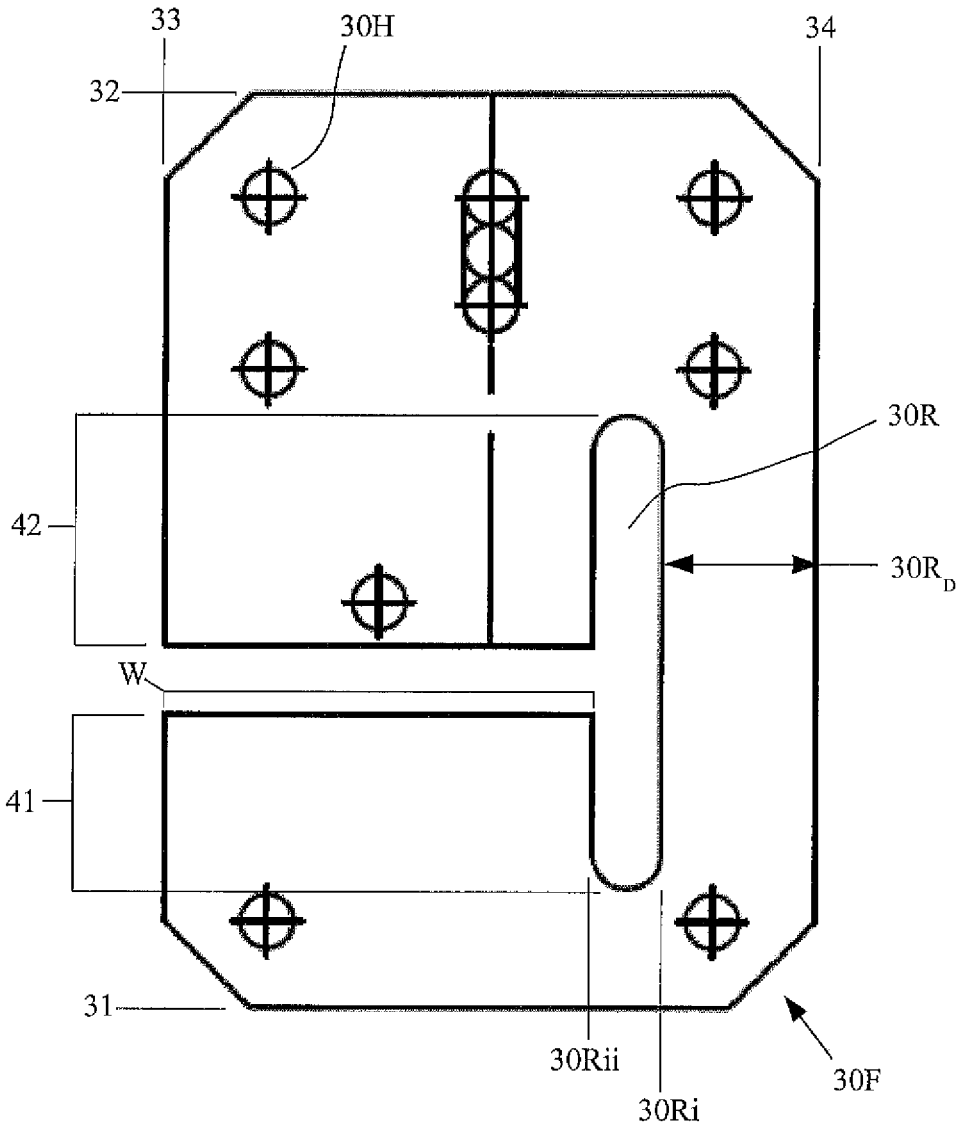
FIG. 11 is an exemplary sheet metal flat pattern that may be used to form the retaining clip of FIG. 8.

A flat pattern 30F for the retaining clip 30 is shown in FIG. 11. The outer periphery may be formed by a stamping or routing process, or other suitable manufacturing process. A plurality of mounting holes 30H may be formed in the flat pattern as select locations. An elongated relief opening 30R may be formed therein, at a distance $30R_D$ from the end 34, and which may have elongated sides 30Ri and 30Rii that may be generally parallel to sides 33/34. A cut may be made in the plate that may generally be orthogonal to the elongated sides 30Ri and 30Rii, to form a first flange 41 and a second flange 42, each of which may have a width W.

Flange 41 may be bent up at a 90 degree angle to be as shown within FIGS. 8 and 9, using a suitable bend radius R. The bend radius R that is used may be a smaller or a larger radius than is shown therein, depending upon the material chosen for the clip, and depending upon other secondary manufacturing operations that may be performed to the bottom surface of the table top, such as cornering by a router, etc.

Flange 42 may be bent to have a first flange portion 42*a* be at an acute angle with respect to the flat plate portion 35, as shown in FIG. 9, using a bend radius R. Flange 42 may have another bend formed thereon to create a flange portion 42*b*. As seen in FIG. 9, the flange portion 42*a* may be bent up so as to be angled towards the first flange 41, and may be at an angle, with respect to flat plate portion 35, being in the range of approximately 30 degrees to 60 degrees. Other angles may be used, as discussed hereinafter. The second flange portion 42*b* may be generally parallel to flange 41, and the inside surfaces of the parallel flange 41 and flange portion 42*b* may be separated by a gap (distance) G (FIG. 9). The relative lengths of the flanges, using this method of formation for clip 30, may be determined by the positioning and the width of the cut made in the plate, which may generally be orthogonal to the elongated sides 30Ri and 30Rii. Shifting the cut in one direction, for example, towards side 32, as seen in FIG. 11, would decrease the length of flange 42 and increase the length of flange 41, whereas shifting it in the opposite direction would increase the length of flange 42 and decrease the length of flange 41. However, using a different method of formation for clip 30 may avoid such a tradeoff in corresponding flange lengths. For example, flange 42 may be formed separately as a bent-up sheet metal part (or as a plastic part) and may be welded (or bonded for the plastic version of the part) to where the flange portion 42*a* extends from the plate portion 35. A butt weld or corner weld or any other suitable weld may be used in place of the formed bend radius R, to join the separate flange member to the plate. Flange 41 may be similarly constructed using a separate member of a suitable length that is welded to a flat plate portion. As another alternative, separately formed flanges 41 and 42 may be mechanically fastened to the plate portion 35, as each may have an integral mounting flange of its own.

Figure 12:
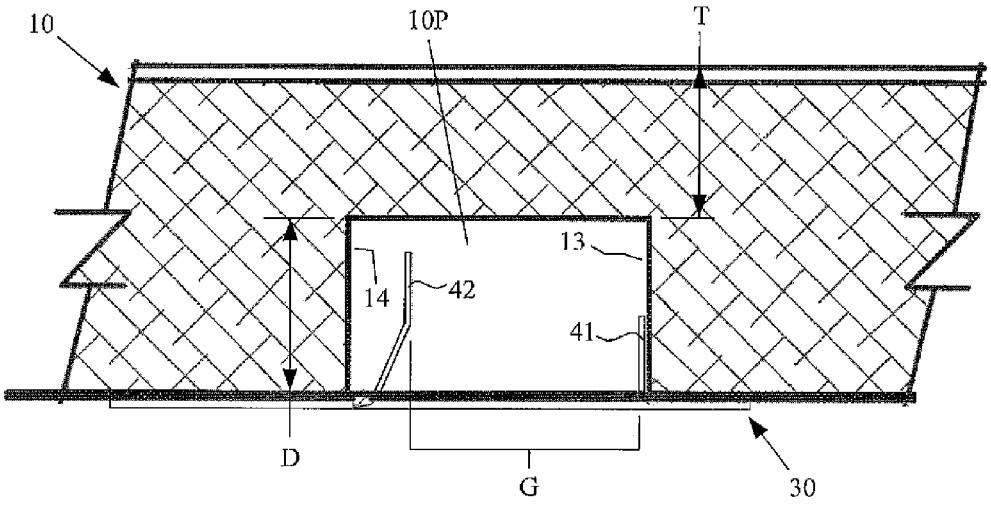
FIG. 12 is a cross-sectional view through the retaining clip and table top of the present invention.
Figure 13:
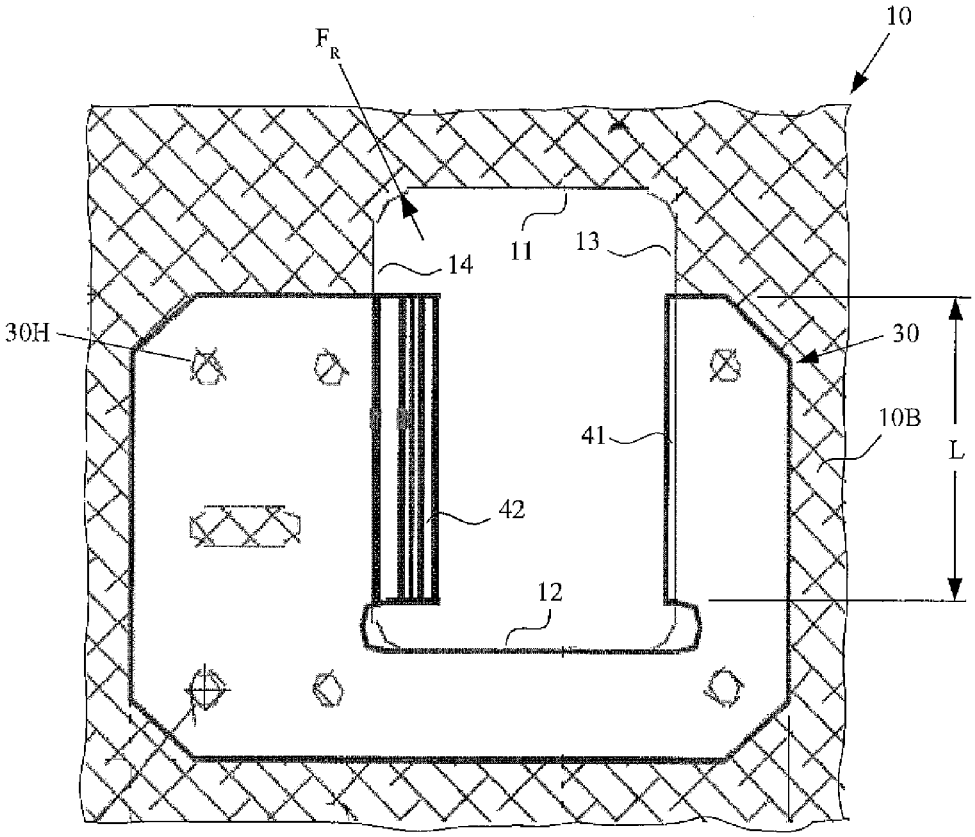
FIG. 13 is a top view of the retaining clip and table top of the present invention.

The retaining clip 30 may be mounted to the bottom surface 10B of the table top 10, as seen in FIG. 13, using wood screws or other mechanical fasteners in the holes 30H, or by being adhesive bonded thereto, or by a combination of the above. FIG. 12 illustrates a cross-section through the retaining clip 30 and table top 10 of FIG. 13.

The bottom surface of the table top 10 may have a plurality of openings 10P formed therein, each of which may be a rectangular opening having four sides, being sides 11, 12, 13, and 14. There may be a fillet radius $F_R$ at each of the intersections of the adjacent sides 11-13, 13-12, 12-14, and 14-11, to facilitate routing of the opening 10P, however, the opening may be formed with a smaller radius or no fillet radius at all. The openings 10P may each be to a depth D, which may result a remaining local thickness T for the tabletop at each opening.

The retaining clip 30 may be mounted to the table top 10 such that a portion of the side 30Ri of the elongated opening may be generally co-planar with side 12 of the opening 10P, but it need not necessarily be so mounted. However, the flange 41 may preferably be mounted so as to contact side 13 of opening 10P, and may be fastened thereto. (Note that in an alternate embodiment, there may be a small gap between flange 41 and side 13). The width W of the flange 41 may be formed to extend for a portion of the side 13, as seen in FIG. 13. For greater stability, the flange width W may be formed to be even longer (i.e., with a greater distance between side 33 and side 34 for the flat pattern in FIG. 11), so that the flange 41 may extend for substantially the full extent of side 13. The flange 42 may protrude into the opening 10P as seen in FIG. 12.

This arrangement is configured to accommodate one of the two legs 21 of the base member 20 shown in FIG. 7A, where the legs may be secured to each other using several different styles of support, including the upper cross-member 22U and lower cross-member 22L shown therein, or other truss-type support arrangements/means.

The cross-sectional shape of the leg 21 may be particularly adapted to be selectively received within the opening 10P with retaining clip 30 secured thereat (FIG. 13). In one embodiment, the cross-section of the end of the leg 21 of base member 20 may have a length that is slightly smaller than the distance between sides 11 and 12 of opening 10P, and would result in a slight clearance fit therebetween. In another embodiment, which may produce greater stability for the leg after being joined to the table top, as discussed hereinafter, the cross-section of the end of the leg 21 may have a length that is slightly greater than the distance between sides 11 and 12 of opening 10P, and would result in a slight friction fit therebetween. The width of the cross-section of the end of the leg 21 of base member 20 may be sized to be greater than the gap G between the flange 41 and flange portion 42*b*.

Several of these structural parameters are preferably correlated to produce satisfactory results. When the leg 21 of base member 20 is inserted through the opening 10P with clip 30 secured to the table top 10, the retaining force—the force opposing separation of the base leg from the table top opening—that is provided by the friction fit with sides 11 and 12 of the opening and by the bearing force and friction created by the deflection of the flange 42, must be great enough to accomplish the objectives required by users of the banquet table. The total retaining force must at least be large enough, so that when the legs of the pair of bases members are assembled into the corresponding openings, and the table is turned upright, the person or persons setting up the banquet table must be able to lift the table and move it around a floor without the legs becoming loosened and falling out. Thus, the force may need to be calibrated to the type of base members utilized, as the weight of the base member may dictate the required retaining force. In addition thereto, the retaining force may need to be large enough so as to provide a sufficient amount of stability for the banquet table, to resist the typical bumping and/or side loading that it may undergo at an event when surrounded and utilized by many people.

The stability of the described structural arrangement of the opening 10P and retaining clip 30 may be further improved by the overall assembly arrangement that is utilized for the required pair of openings necessary to receive the pair of legs 21 of the base member 20. Several different overall assembly embodiments are possible.

Figure 14A:
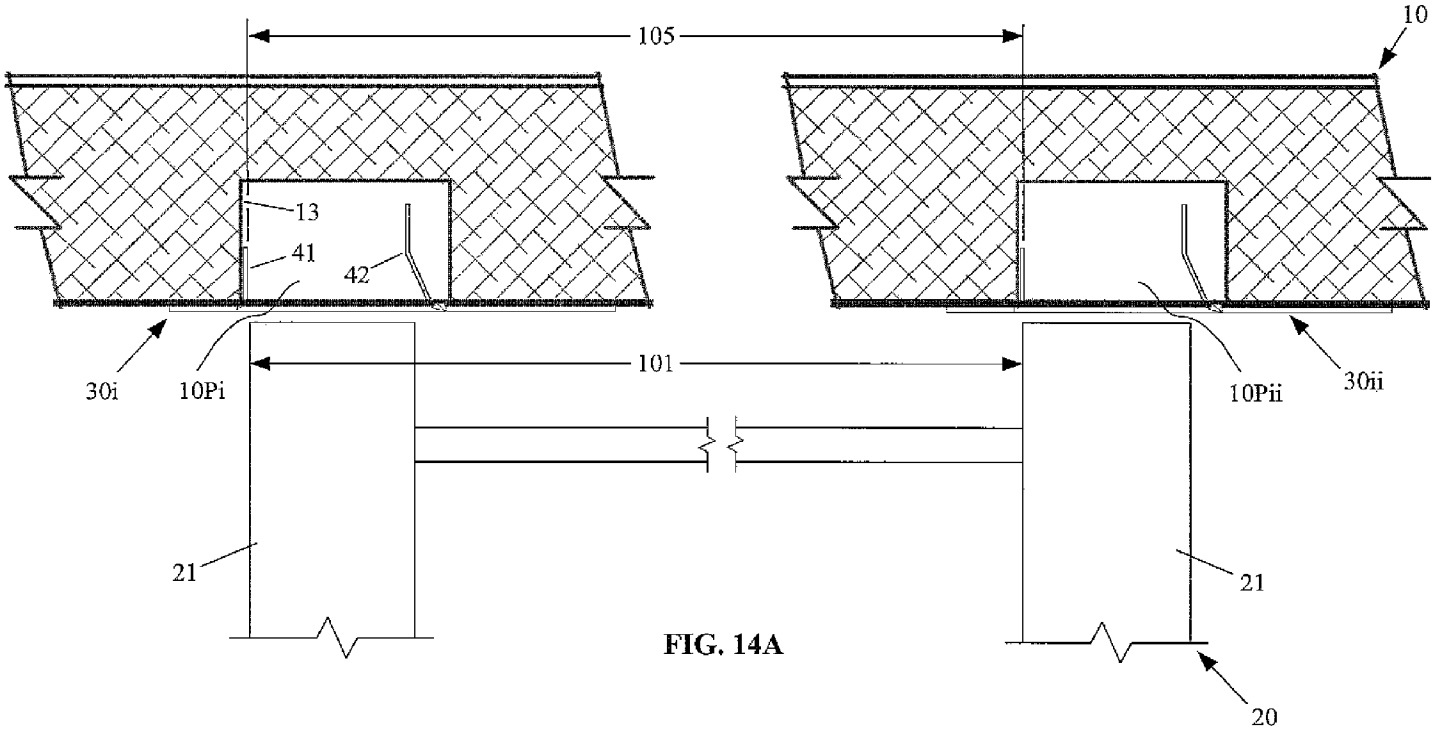
FIG. 14A is a cross-sectional view through the base member and table top of the present invention, taken through a pair of openings in the table top that has respective retaining clips installed thereon to face in the same direction, and showing the base member prior to being releasably secured within the openings using the retaining clips.
Figure 14D:
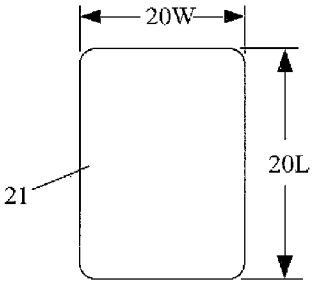
FIG. 14D shows a cross-sectional view of the leg of the base member of FIG. 14C.
Figure 14B:
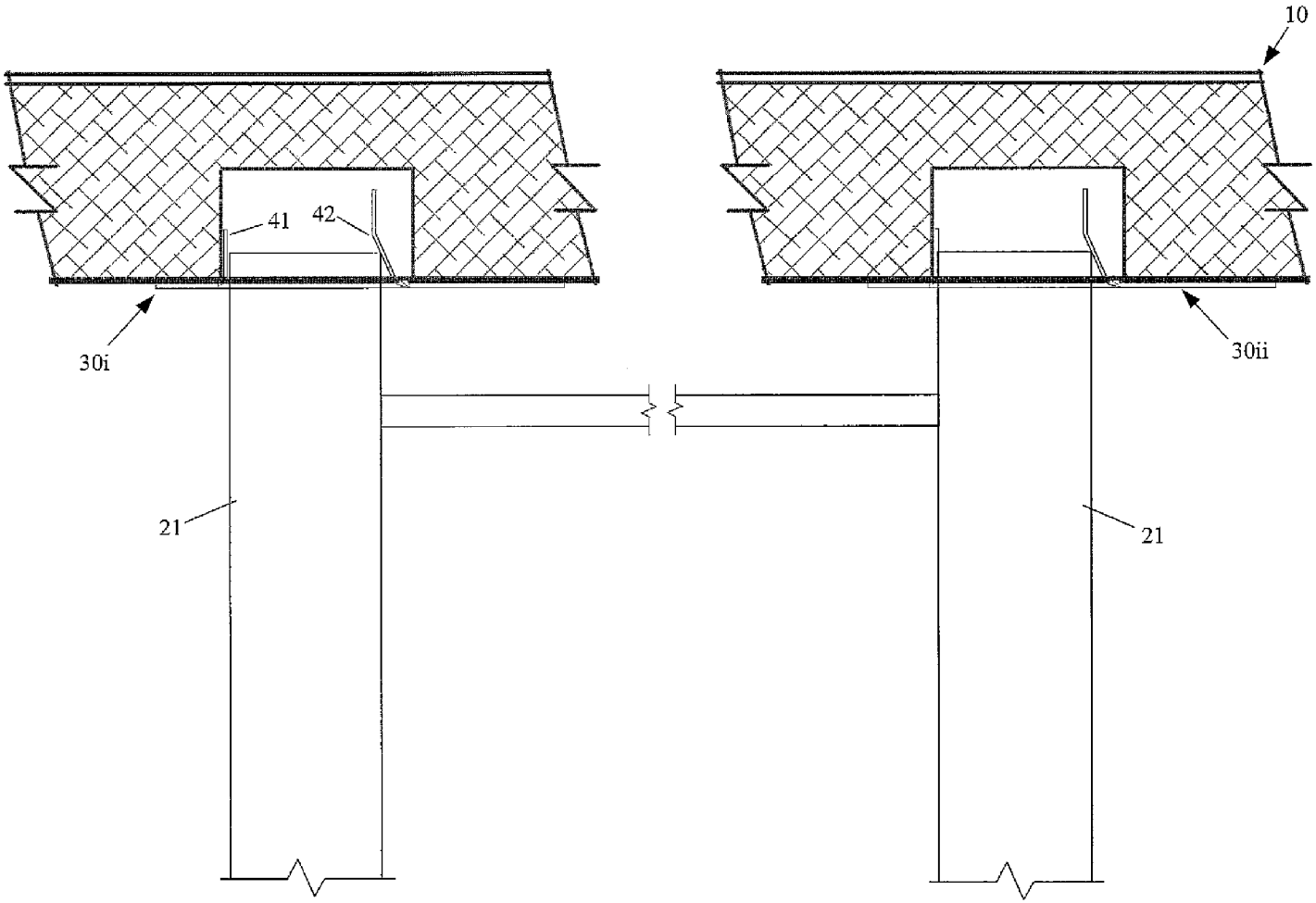
FIG. 14B is the cross-sectional view of FIG. 14A, but showing the legs of the base member after initially entering the corresponding openings in the table top, and just being in contact with the second flange of the retaining clips.
Figure 14C:
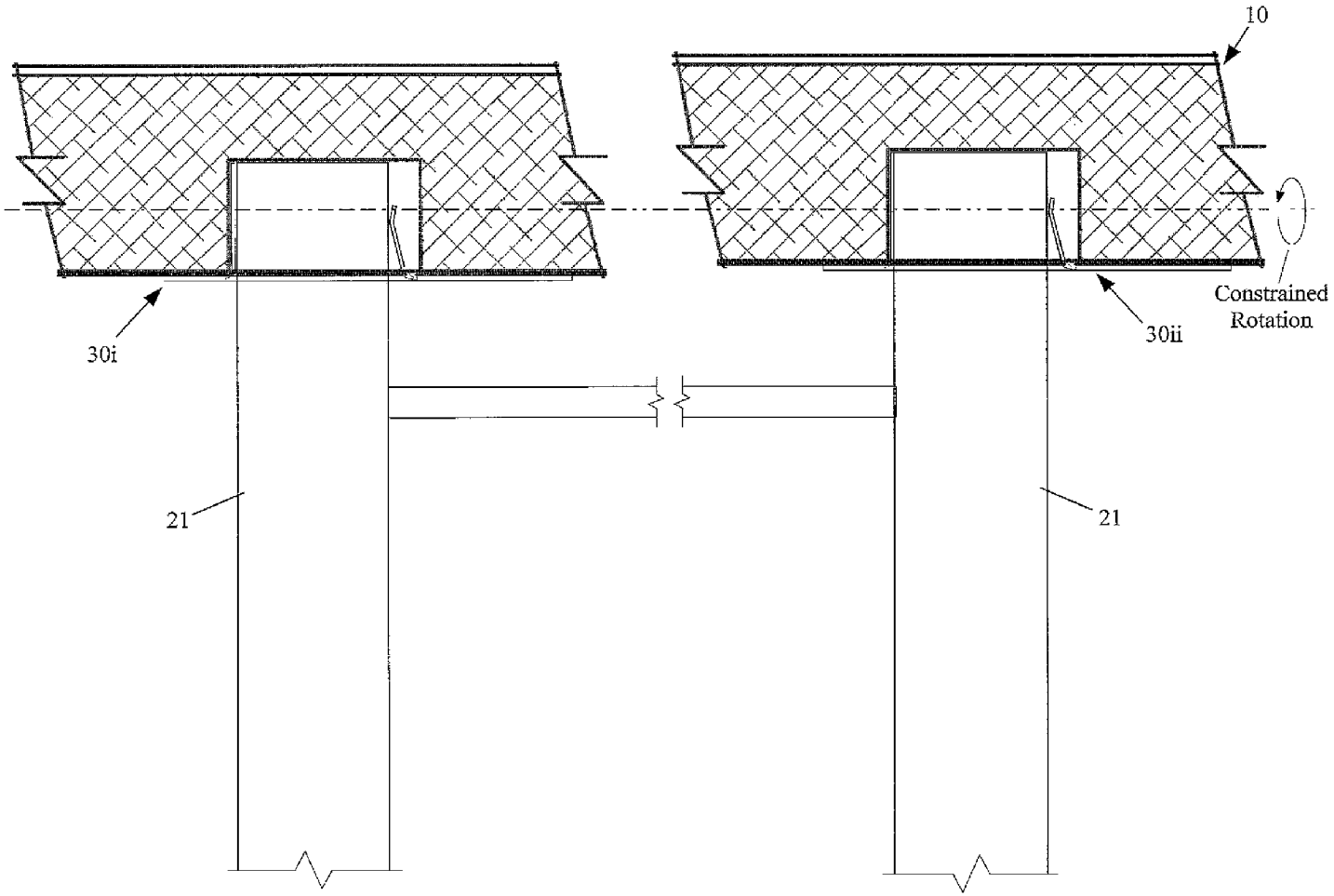
FIG. 14C is the cross-sectional view of FIG. 14B, but showing through the legs of the base member after being fully received within the corresponding openings in the table top, and with the second flange of the retaining clips being deflected elastically to thereby apply a bearing force against the leg to releasably secure the legs therein.

In a first embodiment, which may be understood from viewing FIGS. 14A-14C, a first opening 10Pi on the left side is spaced apart from the second opening 10Pii on the right side. The left-side opening 10Pi may have a first retaining clip 30*i* fixedly secured thereto, while the right-side opening 10Pii may have a second retaining clip 30*ii* be fixedly secured thereat. In this embodiment, the retaining clips 30*i* and 30*ii* may be secured such that the angled flange portions 42*b* of each of the two retaining clips are angled in the same direction. In addition, the retaining clips may be secured such that for each clip, there is a small gap between the flange 41 and the side 13 of the respective openings, 10Pi and 10Pii. Also, each of the openings 10Pi and 10Pii may be formed to have its length (the side 11 to side 12 distance) be slightly greater than the cross-sectional length (20L in FIG. 14D) of each of the ends of the legs 21 to be received therein, to form a clearance fit therebetween. In this first embodiment, the legs 21 of base 20 should having a spacing 101 that is roughly the same as the distance 105 between the sides of the flanges 41 of retaining clips 30*i* and 30*ii*, which should be roughly the same as the distance between the openings 10Pi and 10Pii, if the same gap is used between the flange 41 and the side 13 for both clips.

With this first embodiment for the attachment of the clips 30*i* and 30*ii*, and the formed openings 10Pi and 10Pii, the base 20 may be advanced toward the bottom surface of the table top 10, as seen in FIG. 14B. As the legs 21 each respectively make contact with the flange portions 42*b* of clips 30*i* and 30*ii*, and after the legs ultimately also contact the sides of the flanges 41, continued application of a force to insert the base legs therein is required, as the width of the legs must cause the flanges 42 to deflect, as seen in FIG. 14C. In this first embodiment, since a clearance fit is used with respect to the side 11 to side 12 distance of openings 10Pi/10Pii and the length of the leg cross-section, and since there was a gap between the flanges 41 and the sides 13 of the openings, the retaining force is solely provided by the bearing force applied by the deflected flange 42, which is countered on the opposite side by flange 41, Thus, the width of the base leg is pinched between the flange 41 and flange 42, and some deflection of flange 41 is possible, particularly for any side loading that may be applied to the banquet table at the event for which it is utilized.

The material utilized for the clips 30*i* and 30*ii* may be selected and coordinated with the designed amount of deflection, based upon the gap G and the width 20W of the legs, so that the bearing force created from its deflection is sufficient to retain the base secured within the openings, as seen in FIG. 14C, in spite of the weight of the base and any ordinary handling loads (e.g., minor shaking of the table when being carried, or by its handlers jumping down off of a step or a landing while carrying the table). The material may be spring steel that may be heat-treated after cutting and forming, although other material may similarly be utilized, such as aluminum, titanium, etc. The legs 21 of base 20 may be easily removed by one person of average strength, as they merely need to overcome the bearing force applied by the deflected flanges 42, which should only be roughly the weight of the base 20, plus a small additional amount to account for the above mentioned handling loads. So a person that could carry the base 20, could also accomplish its assembly and disassembly with respect to the table top 10. This embodiment may offer the easiest and least expensive arrangement to manufacture; however, it may not offer as much stability as other arrangements described hereinafter.

In a second embodiment, which is constructed very similar to the one shown by FIGS. 14A-14C, increased stability may be provided by fixedly securing the retaining clips 30*i* and 30*ii* to the table top 10, such that there is no gap between the respective flanges 41 and the sides 13 of the corresponding openings 10Pi and 10Pii. The flanges 41 may furthermore be secured to the side 13 of the table top using screws, or other mechanical fasteners. This would eliminate any tendency of the flanges 41 to deflect, as in the first embodiment, and would offer a limited amount of additional stability to the base, particularly where the flange 41 extends to be proximal to the full depth D of the openings, as seen in FIG. 14C. Where the flange 41 extends to be proximal to this full depth, the depth at which the second flange portion 42*b* is joined to the first flange portion 42*a* (i.e., the location of the bearing force between the flange 42 and the leg of the base member, as seen in FIG. 14C) may preferably be positioned between one-third and two-thirds of the depth D of the opening. It may more preferably be at one-half of the depth D of the opening, to more evenly distribute a bearing load against the leg, and between the leg and the flange 41.

Additionally, in a third embodiment that may provide somewhat greater stability than the second embodiment, each of the openings 10Pi and 10Pii may be formed to have its length (the side 11 to side 12 distance) be slightly less than the cross-sectional length (20L in FIG. 14D) of each of the ends of the legs 21 to be received therein, to form a friction fit therebetween. The total friction force attained for retaining the leg within the table top opening (i.e., the friction fit of the leg with sides 11 and 12 of the opening, and the bearing force and friction created by the deflection of the flange 42 against the leg which bears against the flange 41 that abuts the side 13 of the opening) may still be calibrated to just be sufficiently high enough, as described hereinabove, by adjusting the degree of friction fit between the leg and the sides of the opening, and/or by adjusting the bearing force provided by the deflected flange 42. However, while the total retaining force exerted may be roughly the same, the configuration for receiving the leg is different, and offers more stability, because the ends of the legs of now constrained against rolling within the opening, as to rotation about the axis shown within FIG. 14C (rotation into or out from the paper).

Figure 15A:
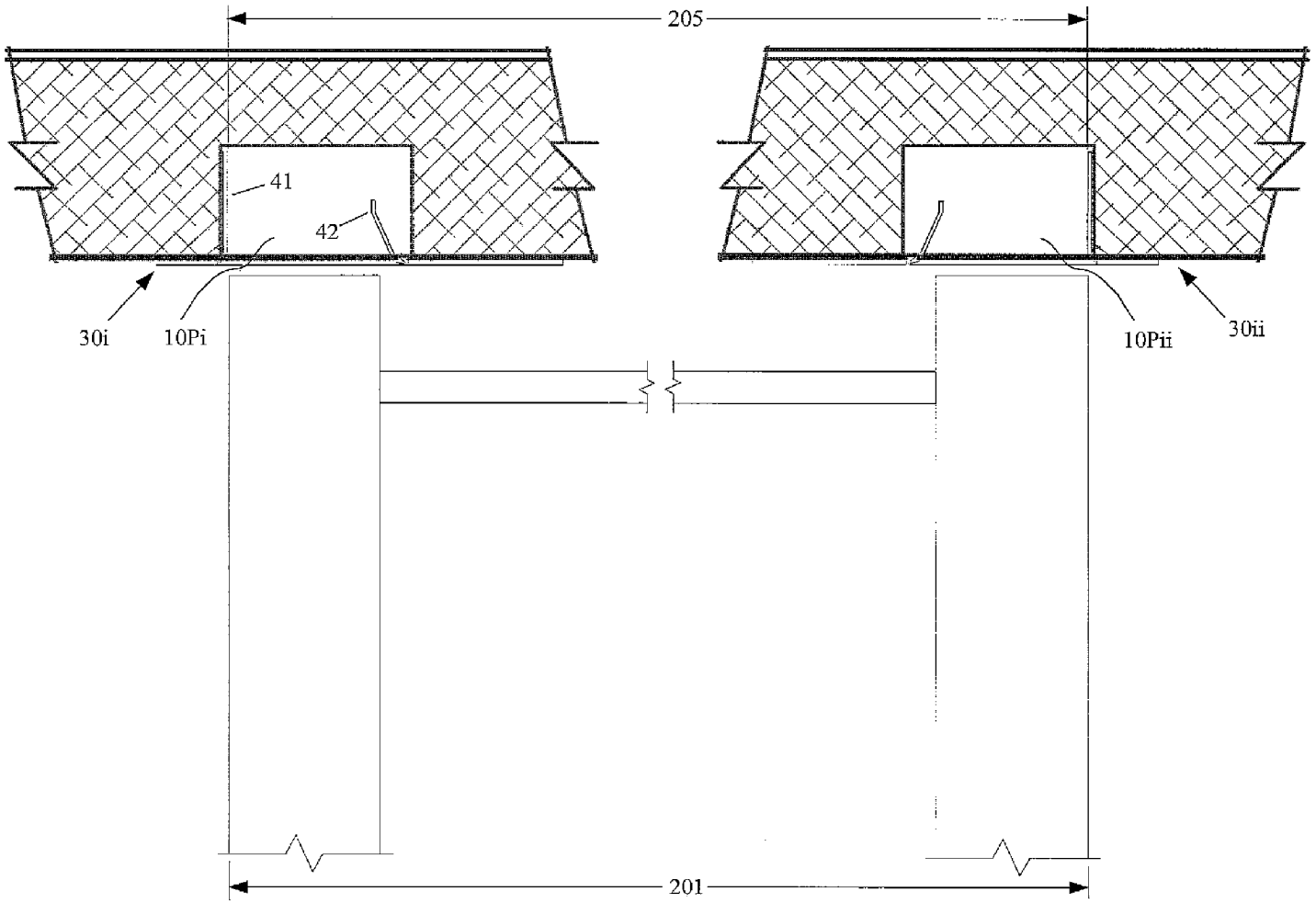
FIG. 15A is the cross-sectional view of FIG. 14A, but with the respective retaining clips installed thereon to face in the same direction.
Figure 15B:
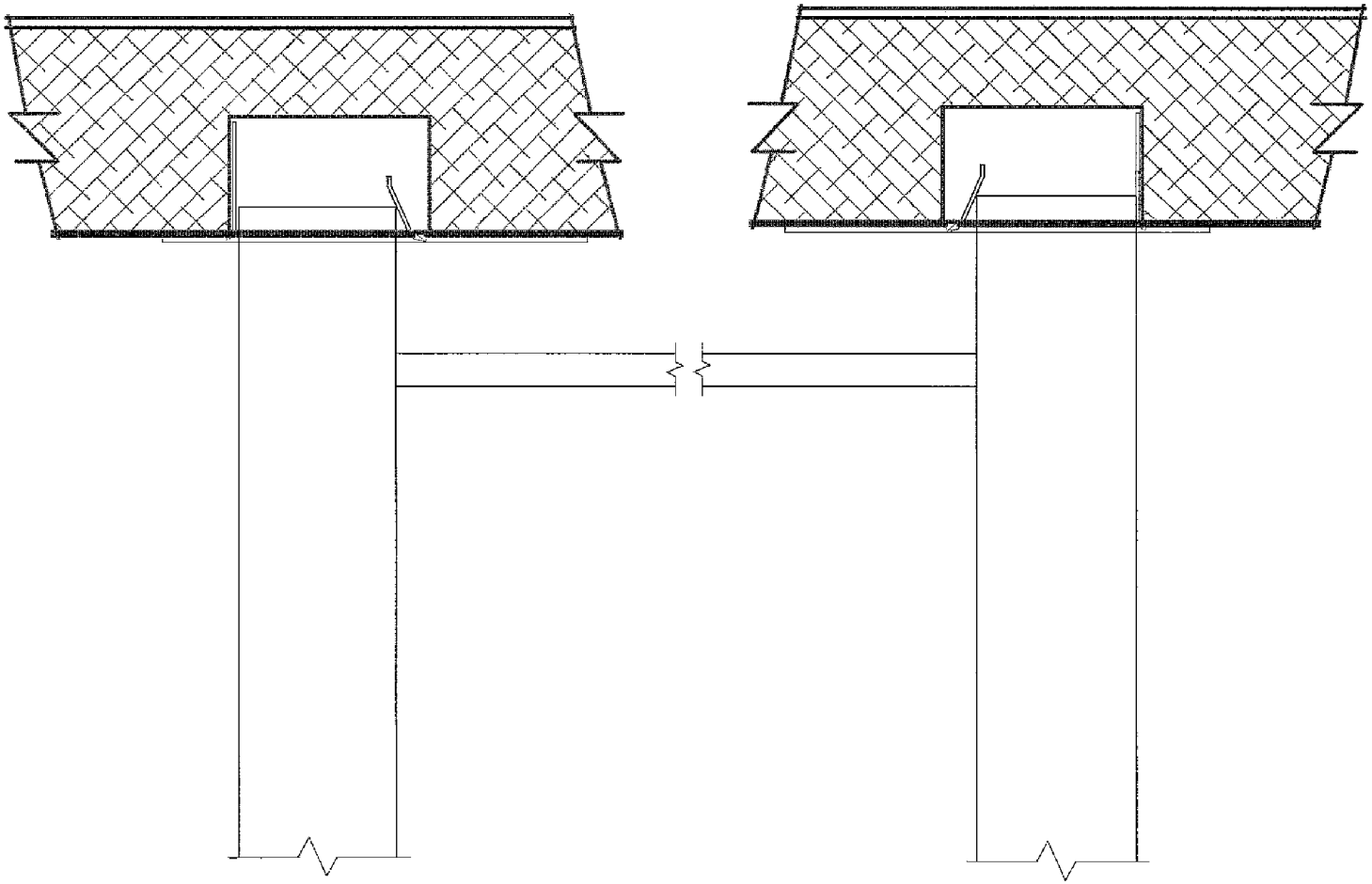
FIG. 15B is the cross-sectional view of FIG. 14B, but with the respective retaining clips installed thereon to face in the same direction.
Figure 15C:
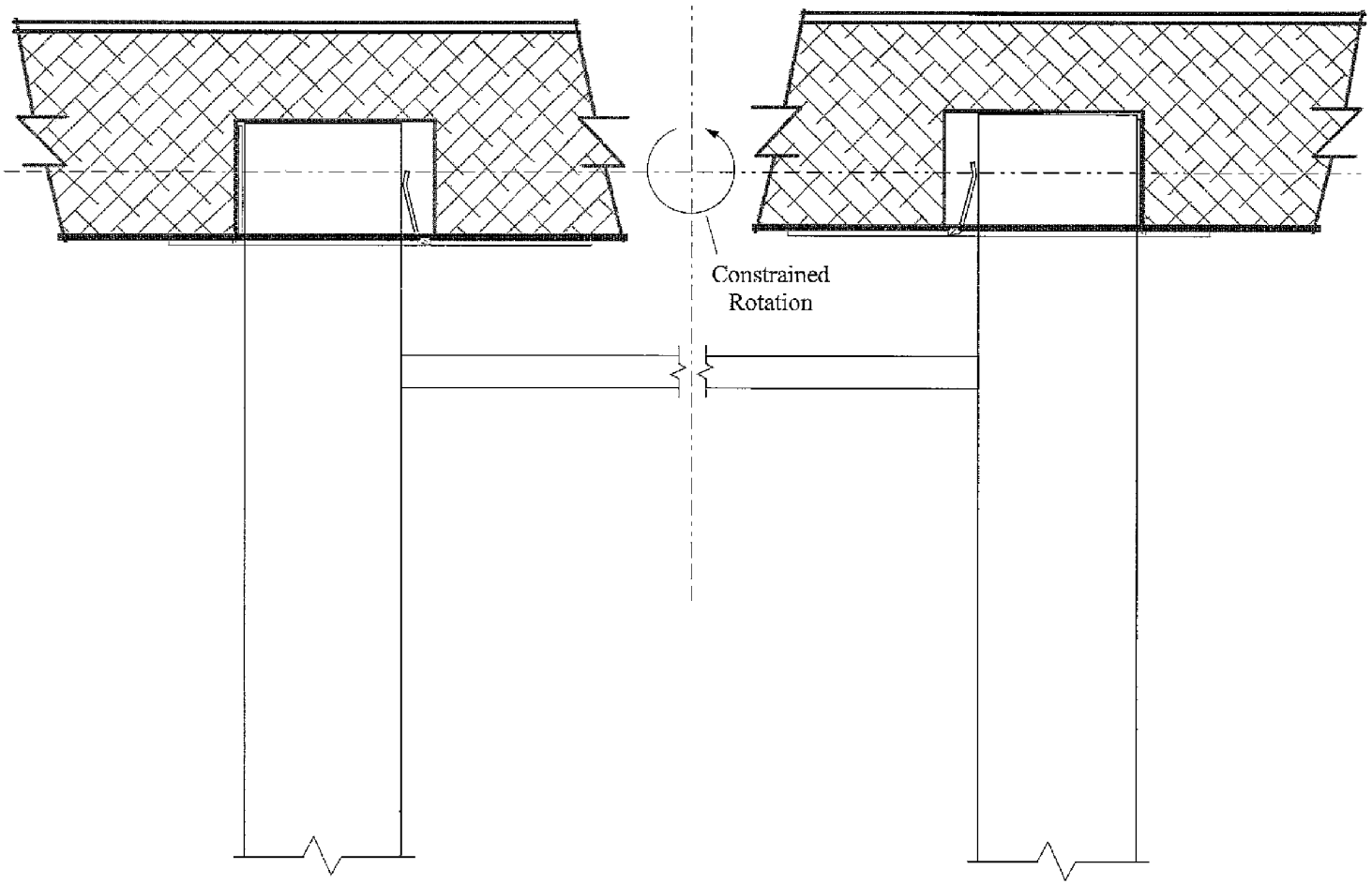
FIG. 15C is the cross-sectional view of FIG. 14C, but with the respective retaining clips installed thereon to face in the same direction.
Figure 15D:
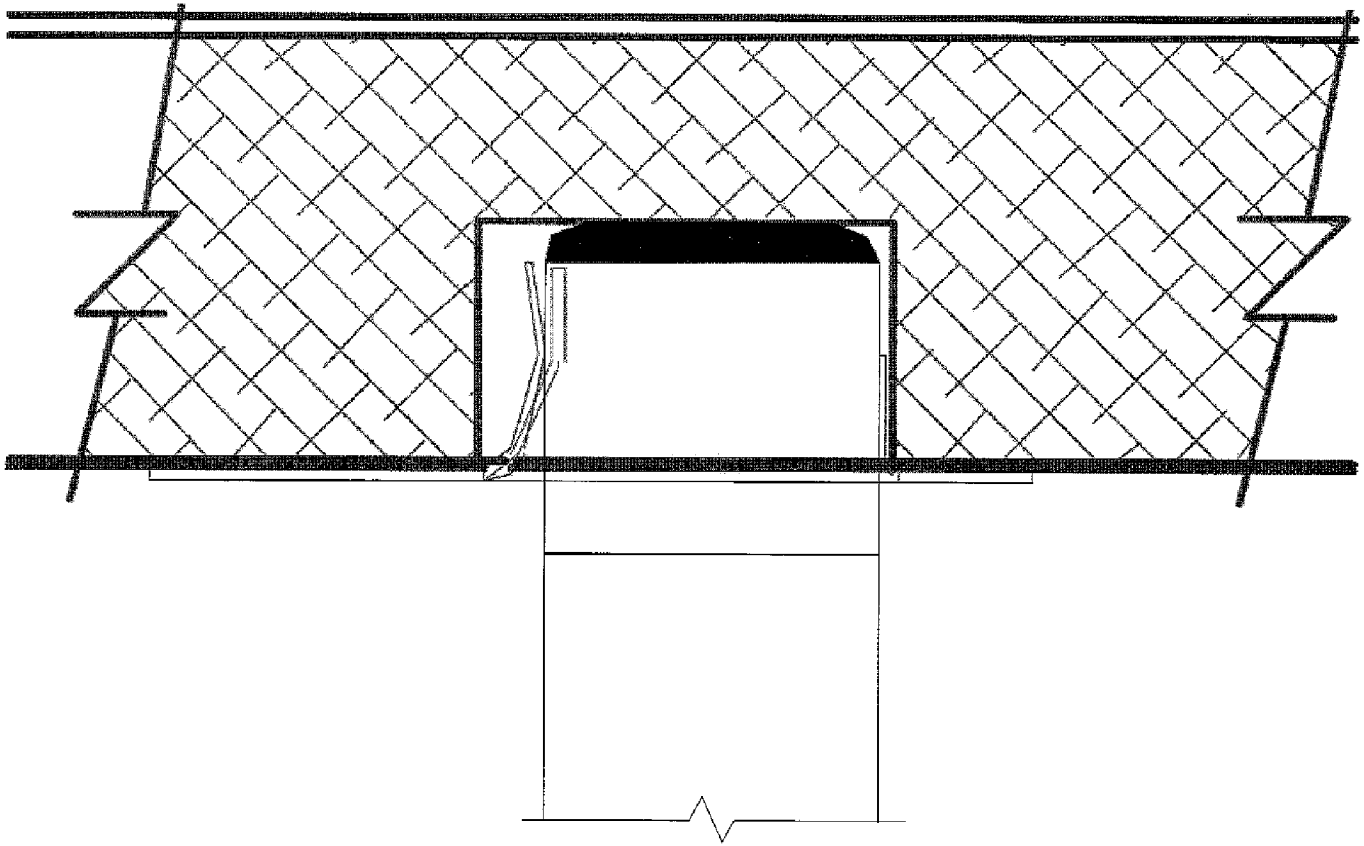
FIG. 15D shows the right side of the cross-sectional view of FIG. 15C, but with the end of the leg being rounds, and with both the un-deflected and the deflected flanges positions shown for the retaining clip.

Moreover, a fourth embodiment may even provide somewhat greater stability than the third embodiment, and is shown by the arrangement in FIGS. 15A-C. This embodiment may be constructed the same as the third embodiment, except that the retaining clips may be secured such that the angled flange portions 42*b* of each of the two retaining clips angle away from each other (i.e., the clips are installed to be mirrored in appearance). Moreover, the openings 10Pi and 10Pii in this embodiment may be spaced apart such that the distance 205 between the inside surfaces of the flanges 41 may be slightly smaller than the distance 201 between the outer sides of the legs 21 of the base 20, as seen in FIG. 15A, and may thus form another friction fit therebetween. Just as with the third embodiment, the total friction force attained for retaining the leg within the table top opening may still be calibrated to just be sufficiently high enough, by individually adjusting the amount of each of those friction fits, which now includes three different friction fits. However, in addition to the stability against rolling of the legs within the openings 10Pi and 10Pii provided by each opening being formed to have its length (the side 11 to side 12 distance) be slightly less than the cross-sectional length (20L in FIG. 14D), the legs are now also contained against rolling with respect to the openings, as to the axis shown within FIG. 15C (rotation in the clockwise or counterclockwise direction on the paper).

The three different friction fits and the two constraints against rolling of the legs work synergistically to amplify the stability of the base to be far greater than may have otherwise been attained by any of the modes of retention being individually utilized.

Figure 16A:
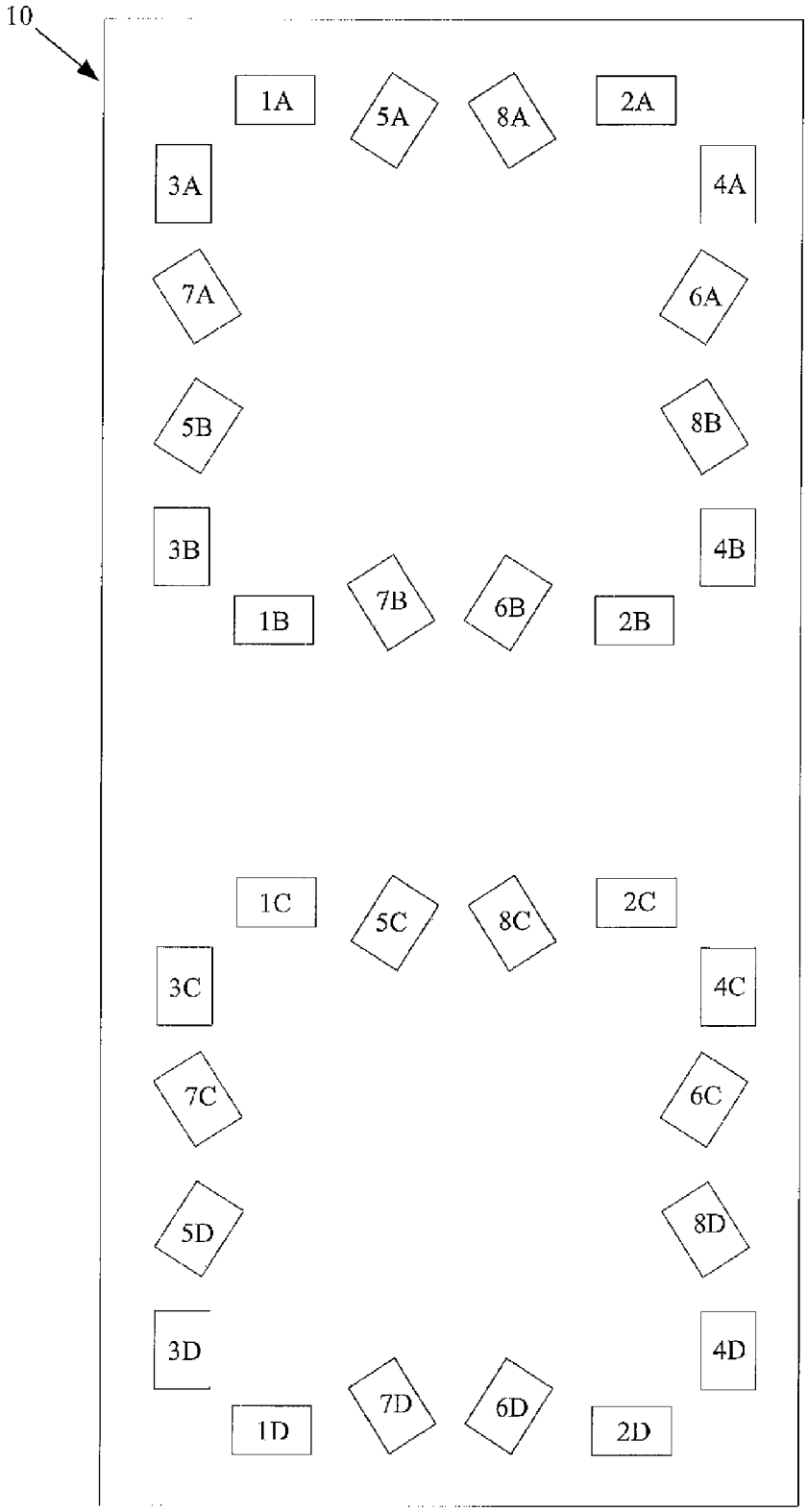
FIG. 16A illustrates the bottom surface of a rectangular-shaped table top of the present invention, showing a plurality of pairs of openings therein, where each opening may have the retaining clip of the present invention secured thereto, and the pairs may be used to receive the legs of the base member of the present invention.

At least two base members 20 may be secured to the table top 10, to provide stable support thereto. In one embodiment for the table top 10, there may only be two corresponding pairs of openings with corresponding retaining clips. However, to permit repositioning of the base members, as described above, there may be a plurality of pairs of openings in the bottom surface of the table top 10, as seen in FIG. 16A, each of which may have a retaining clip be fixedly secured thereto, although they are omitted for clarity within that figure.

Where it is desired to only utilize two base members 20 to support table top 10, the legs 21 of the first base member may be received within the pair of openings 1A and 2A, and the legs of the second base member may be received within openings 1D and 2D. To form the banquet table illustrated in FIG. 1, four base members may be utilized, and may be received in the following pairs of openings: 1A/2A, 3A/3B, 3C/3D, and 1D/2D. The banquet table of FIG. 2 may be formed from this banquet table, simply by repositioning the base from openings 3A/3B to now be received in openings 4A/4B. The banquet tables of FIG. 3 and FIG. 4 may be formed by similarly repositioning the base members to the desired pairs of openings. It should be noted that other pairs of openings maybe utilized in the bottom surface of the table top, other than as illustrated in FIG. 16A, to produce other repositionable table styles.

Figure 16B:
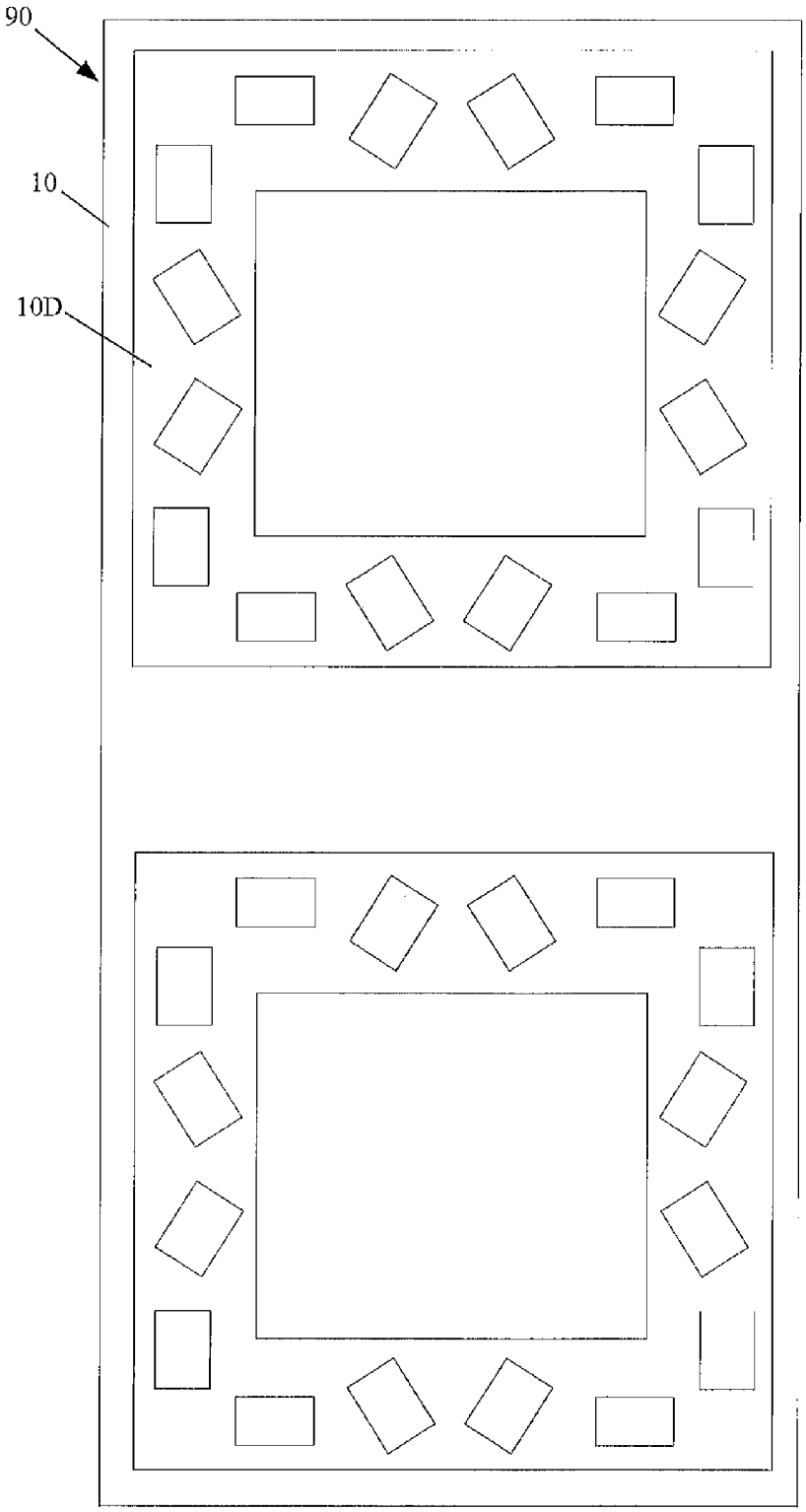
FIG. 16B illustrates the bottom surface of the rectangular-shaped table top of FIG. 16A, but is also shown with a pair of doubler plates attached to the bottom surface of the table top to increase its thickness locally with respect to the pairs of openings.
Figure 17A:
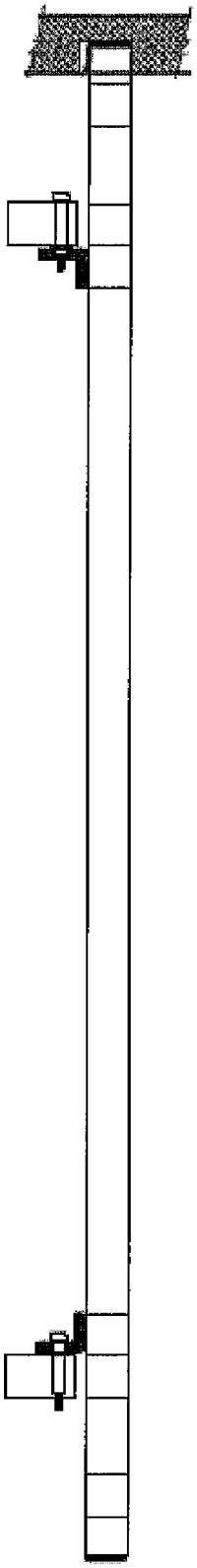
FIG. 17A shows a leg of an alternate embodiment of a base member of the present invention, with the end of the leg received in the table top opening, and with the leg showing a pivotal connection to another base member.
Figure 17B:
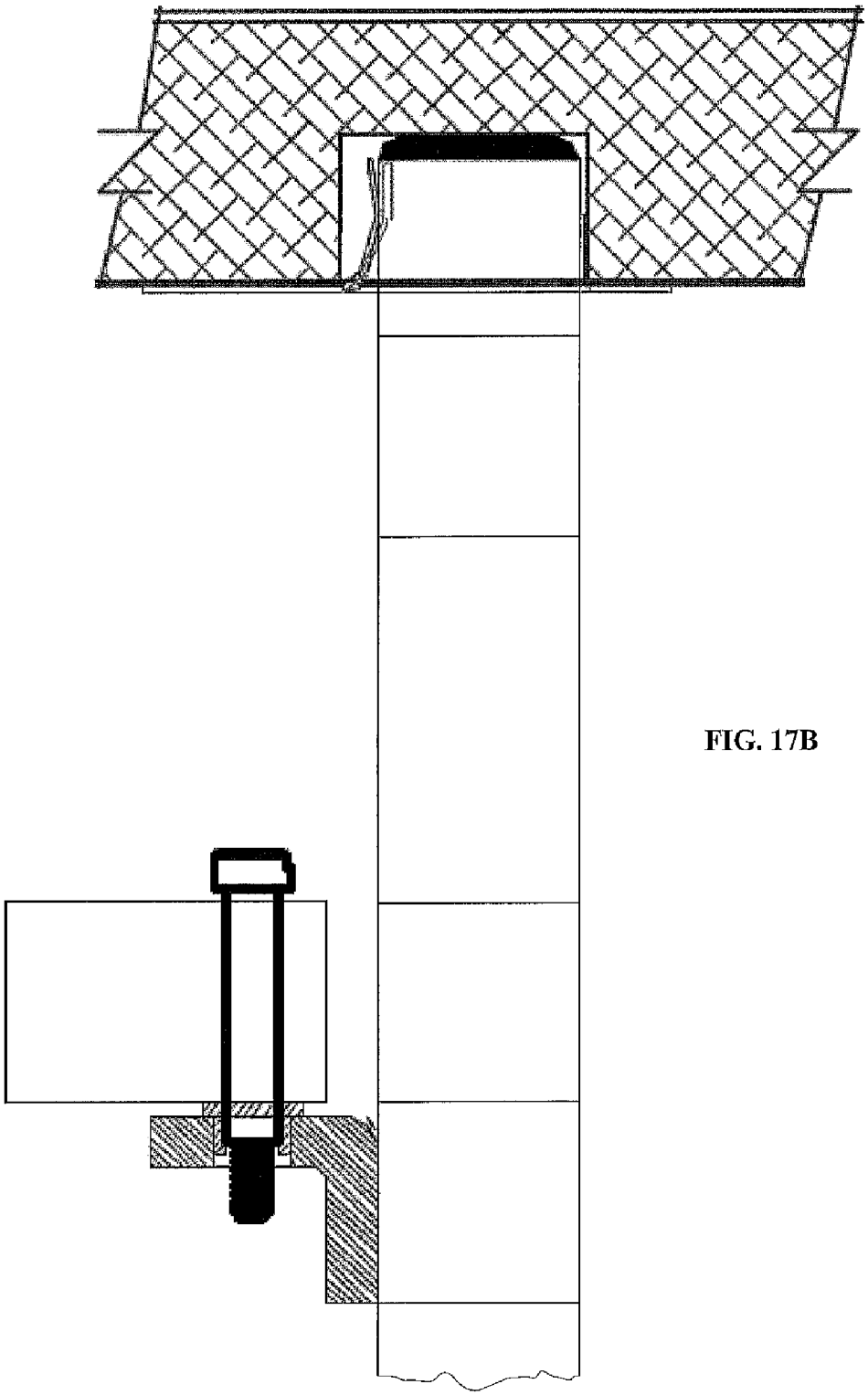
FIG. 17B is an enlarged detail view of alternate embodiment of FIG. 17A.
Figure 18:
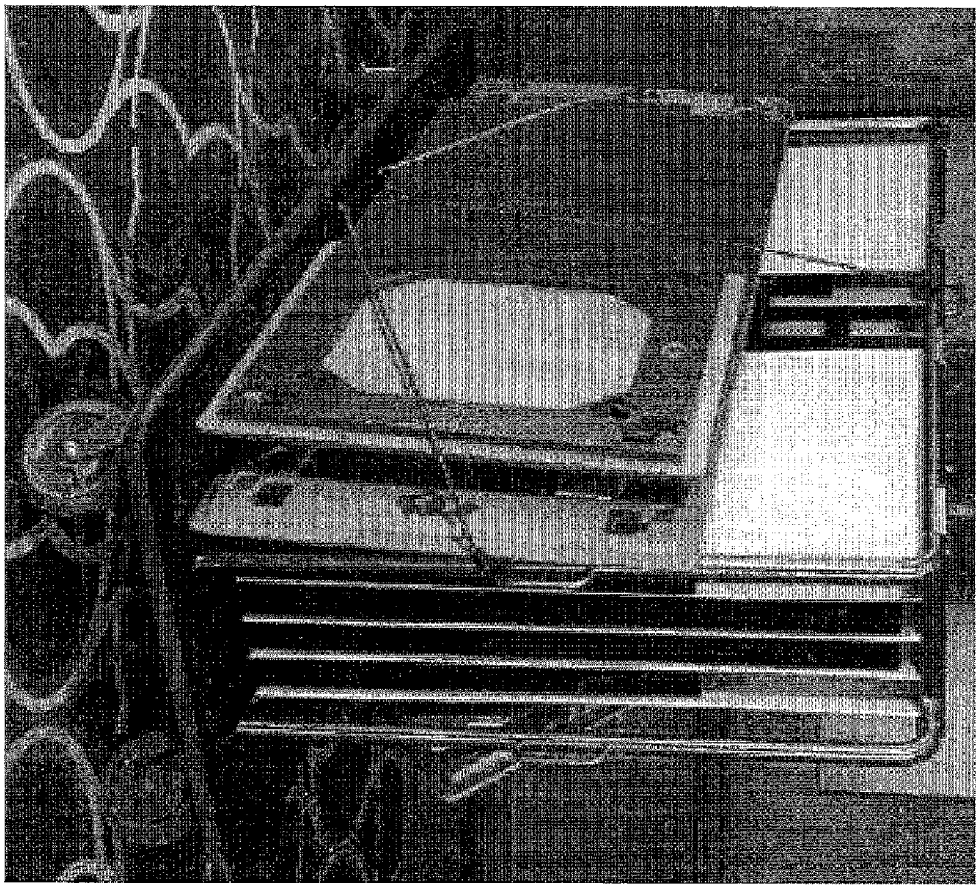
FIG. 18 is a perspective view of a wheeled cart that is particularly adapted for compact storage and transport of the parts of the banquet table of the present invention.

The depth D of the opening in the table top into which the legs of the base are received also serves to affect the stability of the arrangement. Since making the entire table top of a greater thickness may make the top excessively heavy, a rectangular double plate 10D with a large rectangular opening therein may be formed and fixedly secured (bonded, fastened, etc.) to the bottom surface of the table top, as seen in FIG. 16B. (Note, other doubler shapes may be used). The plurality of openings may thereafter be formed in the thicker table top assembly 90, which may include the table top 10 and two doublers 10D, after which the plurality of retaining clips may be fixedly secured to the bottom surface of the doublers.

One further adjustment that may be made to provide even further stability to the table of the present invention may be to pivotally couple two adjoining base member together, as seen in FIG. 7B. So for the above mentioned banquet table in FIG. 1, in which four base members were utilized and its legs were received in the paired openings 1A/2A, 3A/3B, 3C/3D, and 1D/2D, the two base members for the first two pairs of opening may have its legs be pivotally coupled to each other, and the two base members for the second two pairs of opening may also have its legs be pivotally coupled to each other.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A reconfigurable banquet table comprising:

a table top, said table top comprising a top surface and a bottom surface, and a plurality of pairs of openings in said bottom surface;

a corresponding plurality of retaining clips, each said retaining clip mounted to said table top at a respective one of said plurality of pairs of openings, each said retaining clip comprising:

a mounting plate with an opening therein;

a first flange, said first flange having a first end connected to a first side of said opening in said mounting plate, and said first flange configured to extend substantially orthogonally away from a first side of said mounting plate; and a second flange, said second flange comprising: a first flange portion having a first end connected to a second side of said opening in said mounting plate, said first flange portion configured to extend away from said mounting plate at an angle with respect to said first side of said mounting plate, and in a direction being generally toward said first flange; and a second flange portion, a first end of said second flange portion connected to a second end of said first flange portion, and said second flange portion configured to extend therefrom in a direction being substantially parallel to said first flange;

two or more base members, each said base member comprising: a first leg, a second leg, and a connection means configured to fixedly secure said first leg with respect to said second leg; a width of said first end of each of said first and second legs being greater than a distance between said first flange and said second flange; and wherein a first end of each of said first and second legs of each said base member are configured to be inserted into said respective pair of openings in said table top, and be releasably secured therein by said retaining clips, said releasable securement comprising: a side of each said first and second legs configured to contact said first flange, and with said end of each said leg configured to initially contact said first flange portion of said second flange, with said insertion into said openings configured to cause deflection of said second flange to create a bearing force between said leg and said connection of said first flange portion to said second flange portion, and to also create a corresponding bearing force between said side of each said leg in said contact with said first flange.

2. The reconfigurable banquet table according to claim 1 wherein a material of said retaining clips and said angle of said first flange portion with respect to said mounting plate, are configured to provide an amount of said bearing force being greater than a weight of said base member.

3. The reconfigurable banquet table according to claim 1 wherein each said pair of retaining clips are mounted to said respective pair of openings, with said second flange portions of said second flanges configured to respectively angle away from each other.

4. The reconfigurable banquet table according to claim 3 wherein said two or more base members comprises a first pair of base members pivotally connected to each other, and a second pair of base members pivotally connected to each other.

5. The reconfigurable banquet table according to claim 4 wherein each said opening in said table top comprises a rectangular opening; and wherein each said opening in said retaining clip comprises a rectangular opening.

6. The reconfigurable banquet table according to claim 3 wherein a cross-sectional length of each of said legs at said first end, and a corresponding length of said opening in said table top are configured to create a friction fit therebetween.

7. The reconfigurable banquet table according to claim 6 wherein said connection means of each said base member is configured to fixedly secure said first leg apart from said second leg at a distance configured to create a friction fit between each said side of each said leg in said contact with said first flange.

8. The reconfigurable banquet table according to claim 7 wherein said second end of said first flange portion is configured to be at an un-deflected position being substantially between one-third and two-thirds of a depth of said opening in said table top.

9. The reconfigurable banquet table according to claim 8 wherein said second end of said first flange portion is preferably configured to be at an un-deflected position being at one-half of said depth of said opening in said table top.

10. The reconfigurable banquet table according to claim 7 further comprising a doubler plate fixedly secured to said bottom surface of said table top, said doubler plate comprising a plurality of pairs of openings corresponding to said plurality of pairs of openings in said bottom surface of said table top.

11. The reconfigurable banquet table according to claim 10 wherein said second end of said first flange portion is configured to be at an un-deflected position being substantially between one-third and two-thirds of a depth formed by said opening in said table top and said corresponding opening in said doubler.

12. The reconfigurable banquet table according to claim 11 wherein said second end of said first flange portion is preferably configured to be at an un-deflected position being at one-half of said depth formed by said opening in said table top and said corresponding opening in said doubler.

13. The reconfigurable banquet table according to claim 12 wherein a periphery of said table top comprises a geometric shape from the group of geometric shapes consisting of: a circular shape, a square shape, a rectangular shape, a semi-circular shape, and a quarter-ring shape.

14. The reconfigurable banquet table according to claim 7 wherein a material of said retaining clips and said angle of said first flange portion with respect to said mounting plate, are configured to provide an amount of said bearing force that in combination with said friction fit from said cross-sectional length of said legs and said corresponding length of said openings, and said friction fit between each said side of each said leg in said contact with said first flange, total to be greater than a weight of said base member.

* * * * *